US010252431B2

(12) United States Patent
Dryfhout

(10) Patent No.: US 10,252,431 B2
(45) Date of Patent: Apr. 9, 2019

(54) SPONGE FLAP FOR RAZOR

(71) Applicant: Dryfhout Enterprises, LLC, Frankfort, IL (US)

(72) Inventor: Matthew James Dryfhout, Frankfort, IL (US)

(73) Assignee: Dryfhout Enterprises, LLC, Frankfort, IL (US)

( * ) Notice: Subject to any disclaimer, the term of this patent is extended or adjusted under 35 U.S.C. 154(b) by 0 days.

(21) Appl. No.: 15/473,358

(22) Filed: Mar. 29, 2017

(65) Prior Publication Data

US 2018/0281215 A1 Oct. 4, 2018

(51) Int. Cl.

| | |
|---|---|
| ***B26B 21/40*** | (2006.01) |
| ***B26B 21/52*** | (2006.01) |
| ***A45D 27/00*** | (2006.01) |
| ***A47K 7/02*** | (2006.01) |

(52) U.S. Cl.

CPC ..... *B26B 21/4037* (2013.01); *A45D 27/00* (2013.01); *A47K 7/022* (2013.01); *A47K 7/028* (2013.01); *B26B 21/521* (2013.01); *B26B 21/523* (2013.01)

(58) Field of Classification Search

CPC ..... A45D 27/00; A47K 7/022; A47K 7/028; B26B 21/4037; B26B 21/521; B26B 21/523

See application file for complete search history.

(56) References Cited

U.S. PATENT DOCUMENTS

| | | | | | |
|---|---|---|---|---|---|
| 2,677,883 | A * | 5/1954 | Schallgruber | B26B 21/44 | 15/DIG. 3 |
| 3,024,486 | A * | 3/1962 | Naugle | A47K 7/022 | 15/222 |
| 3,063,081 | A * | 11/1962 | Brown | A47K 7/022 | 15/144.1 |
| 3,517,442 | A * | 6/1970 | Regan | B26B 19/40 | 15/244.1 |
| 3,895,437 | A * | 7/1975 | DiBuono | B26B 21/44 | 15/244.2 |
| 5,012,578 | A | 5/1991 | Siefer | | |
| 5,167,069 | A * | 12/1992 | Quinn | B26B 21/523 | 30/527 |
| 5,911,480 | A | 6/1999 | Morgan | | |
| 5,979,006 | A * | 11/1999 | Stokes | A61H 11/00 | 15/222 |
| 7,028,407 | B2 | 4/2006 | Ehrlich | | |
| 8,739,411 | B2 | 6/2014 | Kinghorn | | |

(Continued)

*Primary Examiner* — Hwei-Siu C Payer

(74) *Attorney, Agent, or Firm* — Patents and Licensing LLC; Daniel W Juffernbruch

(57) ABSTRACT

A shaver accessory hinges over a sharp edge of a razor blade of a shaver and comprises an outwardly facing sponge. A substantially planar flap has the sponge and a hinge at one end. The hinge is configured to attach to the shaver with the sponge facing at least outwardly when the flap is hinged over the sharp edge of the razor blade of the shaver. A securing mechanism coupled to another end opposite the one end is configured to variably attach the another end of the substantially planar flap to the shaver when the hinge rotates at least 270 degrees about the end of the shaver handle in either a closed position or an open position. A neoprene fabric sleeve fits over an outer end of a shaver handle to secure the hinge to the shaver.

17 Claims, 15 Drawing Sheets

(56) References Cited

U.S. PATENT DOCUMENTS

| | | | | |
|---|---|---|---|---|
| 2004/0016126 | A1* | 1/2004 | deBlois | B26B 21/446 30/41 |
| 2005/0188554 | A1* | 9/2005 | Kjemhus | B26B 21/40 30/537 |
| 2008/0196740 | A1 | 8/2008 | Velho | |
| 2012/0160257 | A1* | 6/2012 | Jenkins | A47K 7/02 132/200 |
| 2015/0217468 | A1 | 8/2015 | Dryfhout | |
| 2017/0334081 | A1* | 11/2017 | Dryfhout | A45D 27/04 |
| 2018/0281215 | A1* | 10/2018 | Dryfhout | B26B 21/4037 |

* cited by examiner

SPONGE FLAP FOR RAZOR

BACKGROUND OF THE INVENTIONS

1. Technical Field

The present inventions relate shavers and, more particularly, relate to a sponge flap foldable over a razor blade.

2. Description of the Related Art

More recently, it has become popular for men to shave their back side or body. In order to shave one's backside or body one conventionally resorts to using an elongated handle that is attached to a blade.

Applicators have been combined with shavers to enhance shaving. It would be beneficial to have an elongated handle for shaving one's own back with an improved configuration for an applicator combined with a shaver blade.

BRIEF DESCRIPTION OF THE DRAWINGS

The present inventions are illustrated by way of example and are not limited by the accompanying figures, in which like references indicate similar elements. Elements in the figures are illustrated for simplicity and clarity and have not necessarily been drawn to scale.

The details of the preferred embodiments and these and other objects and features of the inventions will be more readily understood from the following detailed description when read in conjunction with the accompanying drawings wherein.

DETAILED DESCRIPTION OF THE PREFERRED EMBODIMENTS

Figure 1:
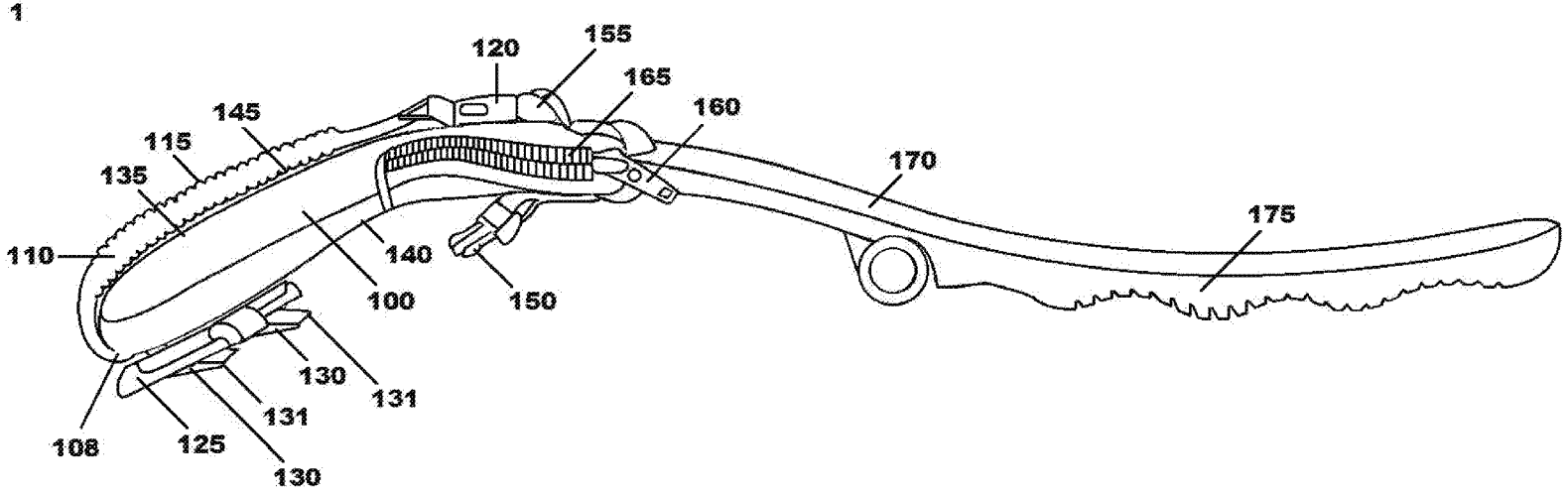
FIG. 1 illustrates a side view of a shaver sponge accessory for a back shaver in an open position according to a first embodiment of the present inventions.

FIG. 1 illustrates a side view of a shaver sponge accessory for a back shaver in an open position according to a first embodiment of the present inventions. A flap has sponge 110. The flap also has a hinge 108 at one end of the sponge 110. The flap also has a first securing mechanism 120 coupled to another end of the sponge 110 opposite the hinge 108.

The sponge 110 is a substantially planar sponge with the hinge 108 at one end of the substantially planar sponge and the first securing mechanism 120 at the another end of the substantially planar sponge. The hinge 108 is a hinge of a kind having at least a 270 degree range of motion. A fabric sleeve 100 sized to fit over an end of a shaver handle 170 opposite a grip 175 of the shaver handle 170. The hinge 108 is coupled to an outer end of the fabric sleeve 100. A top side 135 of the fabric sleeve 100 and a bottom side 140 of fabric sleeve 100 is illustrated in FIG. 1. The fabric sleeve 100 is configured to surround most of the end of the shaver handle 170.

The fabric sleeve 100 has an opening 180 on a razor blade side, the opening 180 of a size sufficient to pass a razor blade mount 190 therethrough. A holder 125 for blade cartridges 130 is illustrated, each blade cartridge 130 having a sharp edge 131. A mount attaches the holder 125 to the handle 170. The mount will be further discussed with respect to the mount 190 which will be illustrated in FIG. 8.

The fabric sleeve 100 has a zipper 165 on a side thereof for closing the fabric sleeve 100 secured around the end of the shaver handle 170. A zipper pull 160 runs a traveler up and down the side of the sleeve 100 to open and close the zipper 165.

Figure 3:
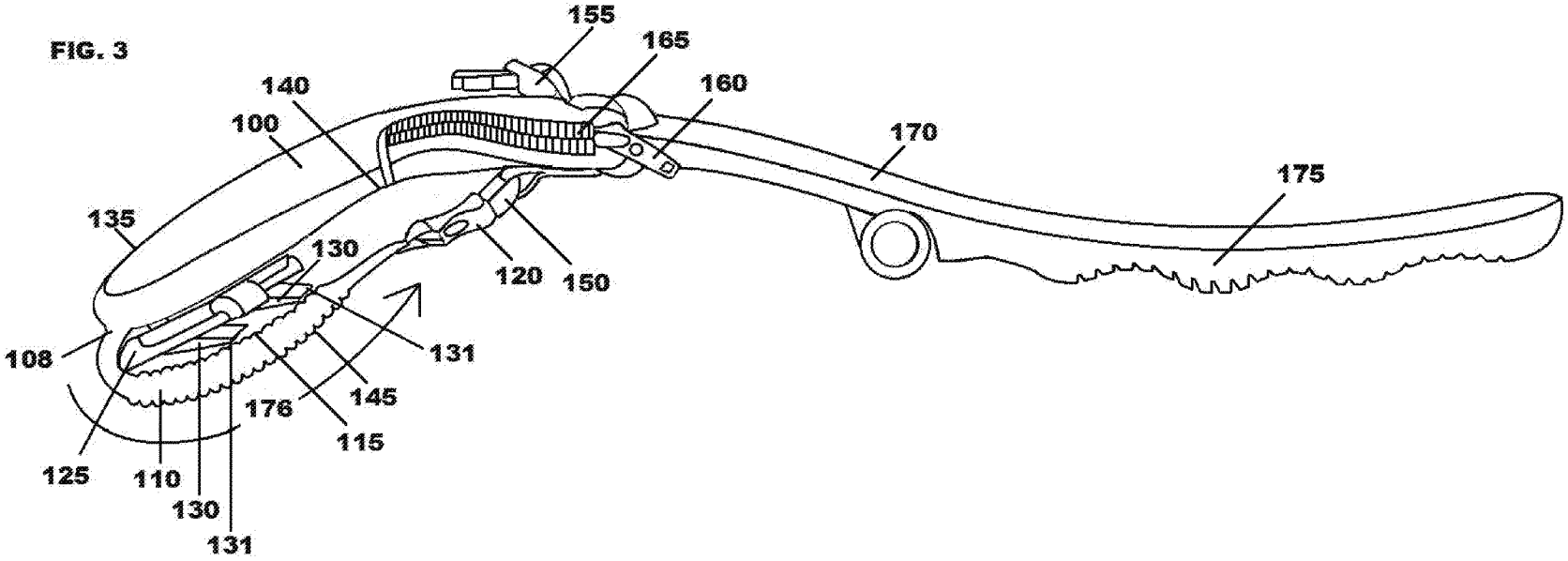
FIG. 3 illustrates a side view of a shaver sponge accessory for a back shaver in a closed position according to the first embodiment of the present inventions.

The fabric sleeve 100 has a second securing mechanism 155 configured to selectively attach to the first securing mechanism 120 when the flap is closed at the hinge 108 over a sharp edge 131 of a razor blade 130 with a primary surface 145 of the sponge 110 facing outwardly as illustrated in FIG. 3. The sponge 110 also has a secondary surface 115.

The first securing mechanism 120 and the second securing mechanism 155 each have complementary sides of a buckle pair 120, 155.

The fabric sleeve 100, 200 has a third securing mechanism 150, 250 configured to join to the first securing mechanism 120 when the hinge 108 is rotated at least 270 degrees in an opposite, open direction away from the razor blade 130 with the primary surface 145 of the sponge 110 facing inwardly as illustrated in FIG. 1.

The fabric sleeve 100 has a second securing mechanism 155 configured to selectively attach to the first securing mechanism 120 when the flap is closed at the hinge 108 over a sharp edge 131 of a razor blade 130 with a primary surface 145 of the sponge 110 facing outwardly as will be illustrated in FIG. 3.

The first securing mechanism 120 and the second securing mechanism 155 each have complementary sides of an outside buckle pair 120, 155. The first securing mechanism 120 and the third securing mechanism 150 each have complementary sides of an inside buckle pair 120, 150.

The first securing mechanism 120 is further configured to variably attach the another end of the substantially planar flap to the shaver when rotated about the hinge 108 in an open position as illustrated in FIG. 1.

The fabric sleeve 100 can be made from a stretchy fabric such as a neoprene fabric. This fabric has stretchy characteristics to confirm to a shape of the end of the back shaver handle 170.

The hinge 108 allows the sponge 110 to selectively cover the blade cartridges 130 to prevent cutting by the sharp edges 131 when in the closed position. In the closed position (FIG. 3), the blade cartridges 130 act as a foundation for the sponge 110 when pressing the sponge 110 against the skin. The primary surface 145 of sponge 110 can be used to apply lotion or soap to the skin on back side of a user when the user reaches around the torso using the back shaver handle 170. The sponge 110 is preferably of a sponge material having rigidity or thickness characteristics enough that gaps between two or more blade cartridges 130 act as a foundation while keeping the sponge 110 relatively planar when pressing against skin. In an alternative embodiment the secondary surface 115 of the sponge 110 in the open position of FIG. 1 can alternatively be used to apply soap or lotion to skin on the back side of a user while shaving without rotating the flat about the hinge 108.

Figure 2:
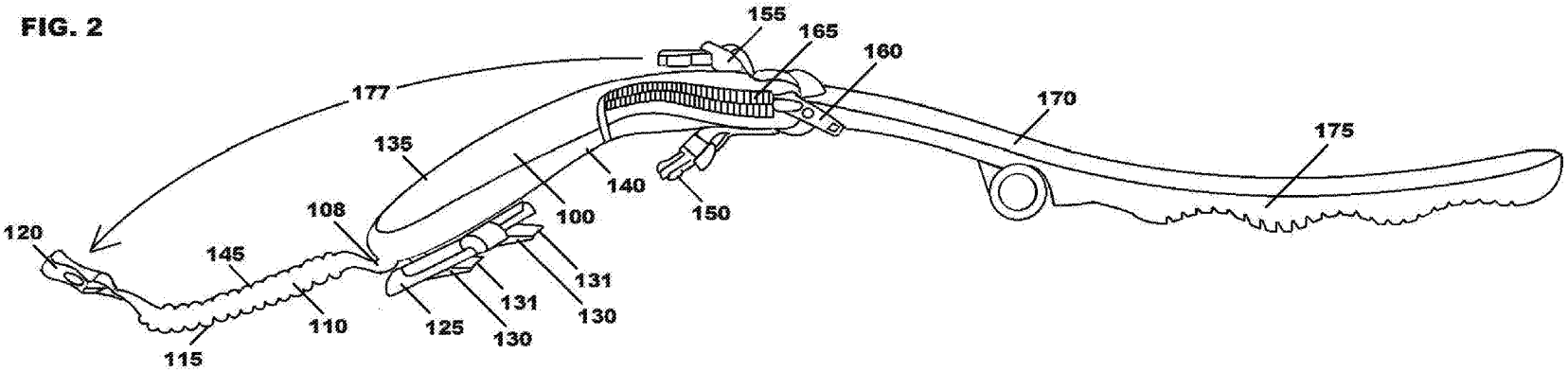
FIG. 2 illustrates a side view of a shaver sponge accessory for a back shaver rotating about a hinge according to the first embodiment of the present inventions.

FIG. 2 illustrates a side view of a shaver sponge accessory for a back shaver rotating about a hinge according to the first embodiment of the present inventions. Like reference numbers in FIG. 2 are described with respect to the textual description of FIG. 1. The hinge 108 of the flap has the illustrated hinge construction capable of rotating at least 270 degrees between the closed position (FIG. 3) and the open position (FIG. 1). The angle of at least 270 degrees is the sum of upper arc 177 illustrated in FIG. 2 plus lower arc 176 illustrated in FIG. 3.

FIG. 3 illustrates a side view of a shaver sponge accessory for a back shaver in a closed position according to the first embodiment of the present inventions. The hinge 108 is configured to attach to the shaver with the sponge 110 facing outwardly when the flap is hinged over a sharp edge 131 of a razor blade cartridge 130 of the shaver as illustrated in FIG. 3. The fabric sleeve 100 has a second securing mechanism 155 configured to selectively attach to the first securing mechanism 120 when the flap is closed at the hinge 108 over a sharp edge 131 of a razor blade 130 with a primary surface 145 of the sponge 110 facing outwardly as illustrated in FIG. 3. The first securing mechanism 120 is configured to variably attach the another end of the substantially planar flap to the shaver when rotated about the hinge 108 in a closed position with the sponge 110 facing at least outwardly when the flap is hinged over the sharp edge 131 of the razor blade cartridge 130 of the shaver in a closed position as illustrated in FIG. 3. The hinge 108 of the flap has the illustrated hinge construction capable of rotating at least 270 degrees between the closed position (FIG. 3) and the open position (FIG. 1). The angle of at least 270 degrees is the sum of upper arc 177 illustrated in FIG. 2 plus lower arc 176 illustrated in FIG. 3. Any other like reference numbers in FIG. 3 are described with respect to the textual description of FIG. 1.

Figure 4:
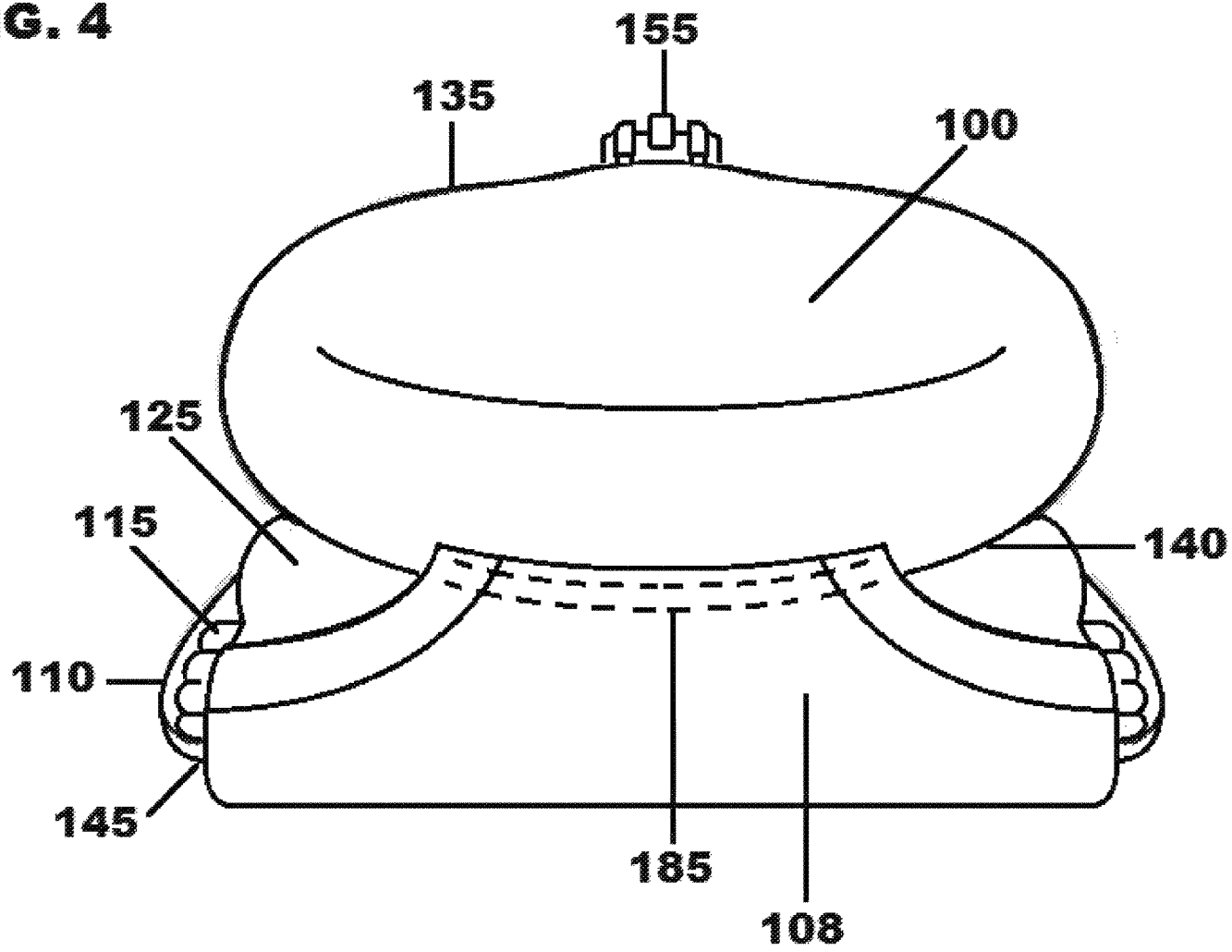
FIG. 4 illustrates an end view of a shaver sponge accessory for a back shaver in the closed position according to the first embodiment of the present inventions.

FIG. 4 illustrates an end view of a shaver sponge accessory for a back shaver in the closed position according to the first embodiment of the present inventions. The hinge 108 has threads 185 as illustrated in FIG. 4 stitched by thread stitches 185 to join the fabric sleeve 100 and the flap with sponge 110. The fabric sleeve 100 is configured to surround most of the end of the shaver handle 170. The fabric sleeve 100 has an opening on a razor blade side, the opening 180 of a size sufficient to pass a razor blade mount therethrough. Any other like reference numbers in FIG. 4 are described with respect to the textual description of FIG. 1.

Figure 5:
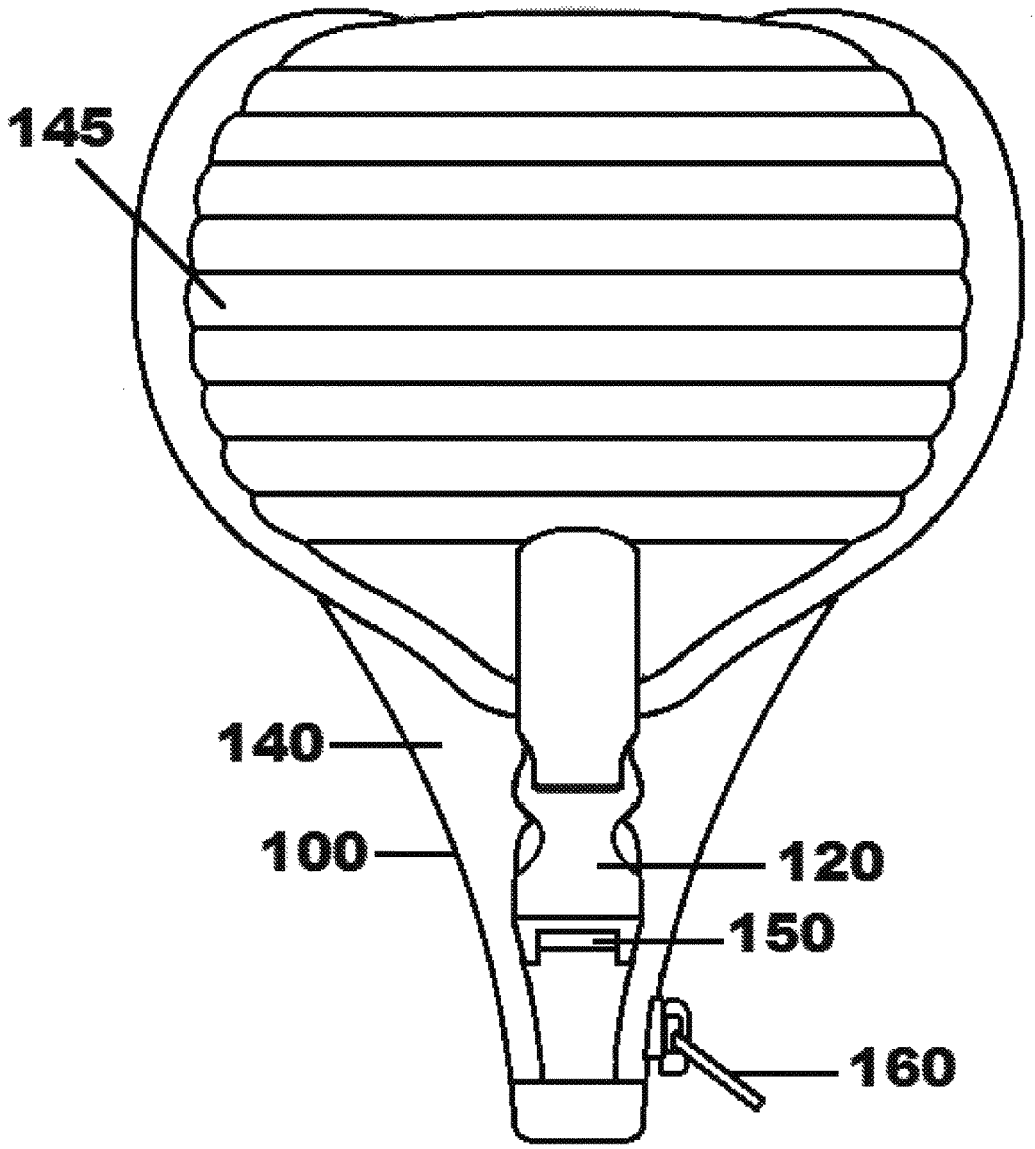
FIG. 5 illustrates an inside view of a shaver sponge accessory for a back shaver in the closed position according to the first embodiment of the present inventions.

FIG. 5 illustrates an inside view of a shaver sponge accessory for a back shaver in the closed position according to the first embodiment of the present inventions. The fabric sleeve 100 is configured to surround most of the end of the shaver handle with the bottom side 140 showing. A primary surface 145 of the sponge faces outward when in the closed position. Buckle pair 120, 150 is illustrated attached inward when in the illustrated closed position. The zipper pull 160 is illustrated on a side of the fabric sleeve 100.

Figure 6:
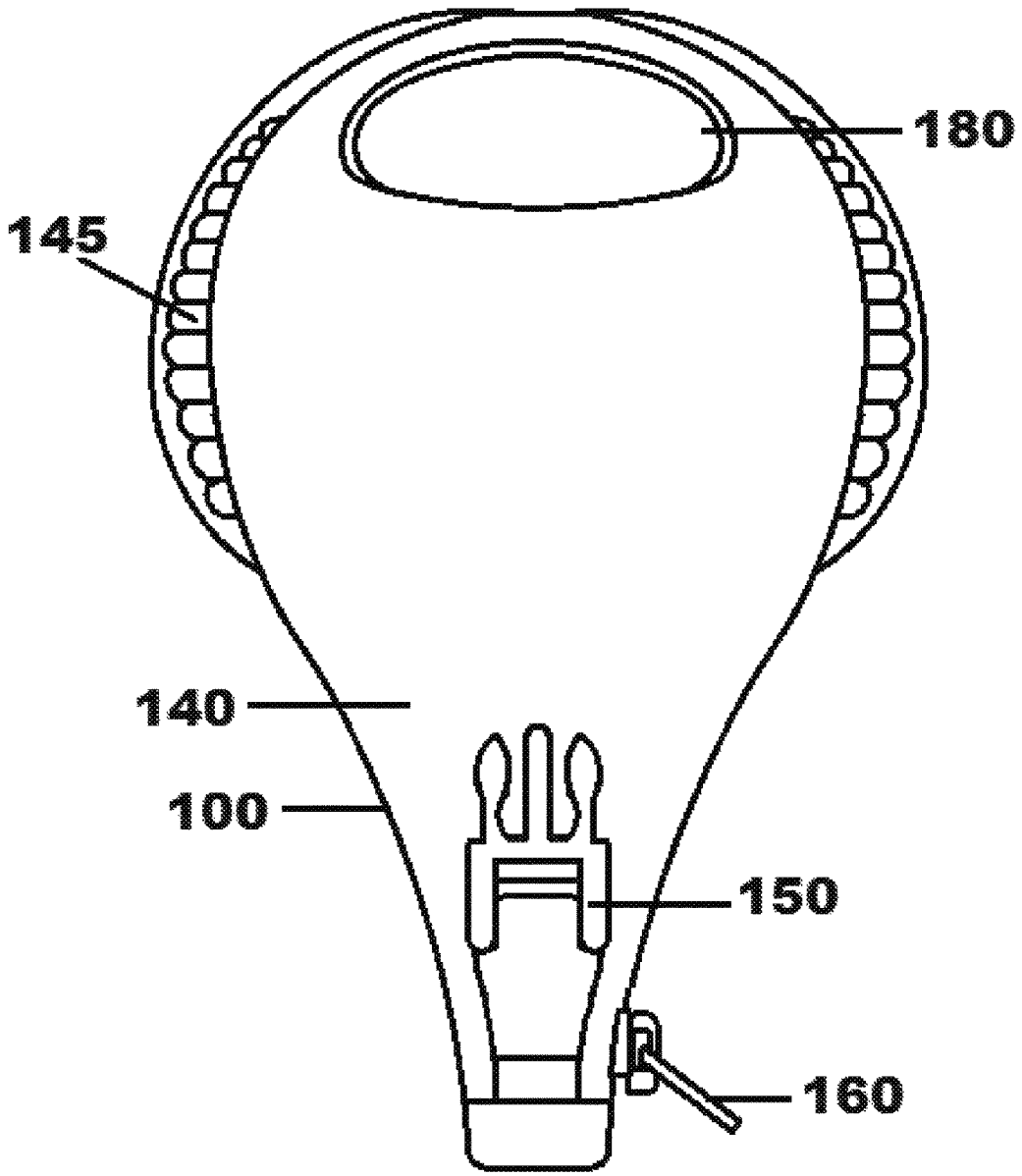
FIG. 6 illustrates an inside view of a shaver sponge accessory for a back shaver in the open position according to the first embodiment of the present inventions.

FIG. 6 illustrates an inside view of a shaver sponge accessory for a back shaver in the open position according to the first embodiment of the present inventions. The fabric sleeve 100 is configured to surround most of the end of the shaver handle with the bottom side 140 showing. A primary surface 145 of the sponge faces inward when in the illustrated open position. The fabric sleeve 100 has an opening 180 on a razor blade side, the opening 180 of a size sufficient to pass a razor blade mount 190 therethrough. Buckle 150 is illustrated unattached when in the illustrated open position. The zipper pull 160 is illustrated on a side of the fabric sleeve 100.

Figure 7:
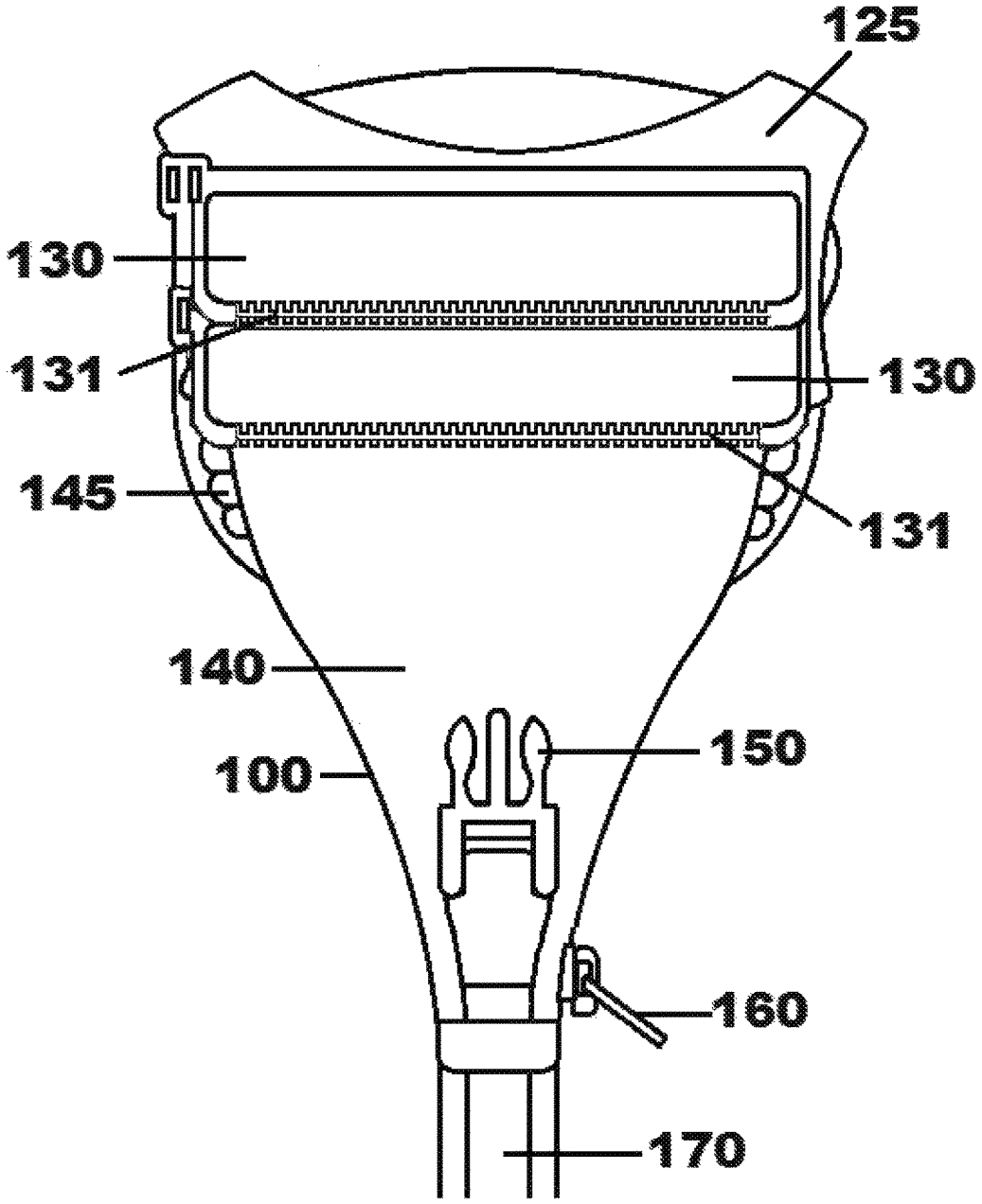
FIG. 7 illustrates an inside view of a shaver sponge accessory for a back shaver in the open position with blade cartridges and also the back shaver handle according to the first embodiment of the present inventions.

FIG. 7 illustrates an inside view of a shaver sponge accessory for a back shaver in the open position with a holder 125 for blade cartridges 130 having sharp edges 131 and also the back shaver handle 170 according to the first embodiment of the present inventions. Holder 125 is illustrated held by the munt to the back shaver handle. Blade cartridges 130 are held by the holder 125. Each blade cartridge 130 has a sharp edge 131 on a side of a metal razor blade and a comb and a guard adjacent to a metal razor blade on opposite sides of the metal razor blade. The fabric sleeve 100 is configured to surround most of the end of the shaver handle with the bottom side 140 showing. A primary surface 145 of the sponge faces inward when in the illustrated open position. Buckle 150 is illustrated unattached when in the illustrated open position. The zipper pull 160 is illustrated on a side of the fabric sleeve 100. Any other like reference numbers in FIG. 7 are described with respect to the textual description of FIG. 1.

Figure 8:
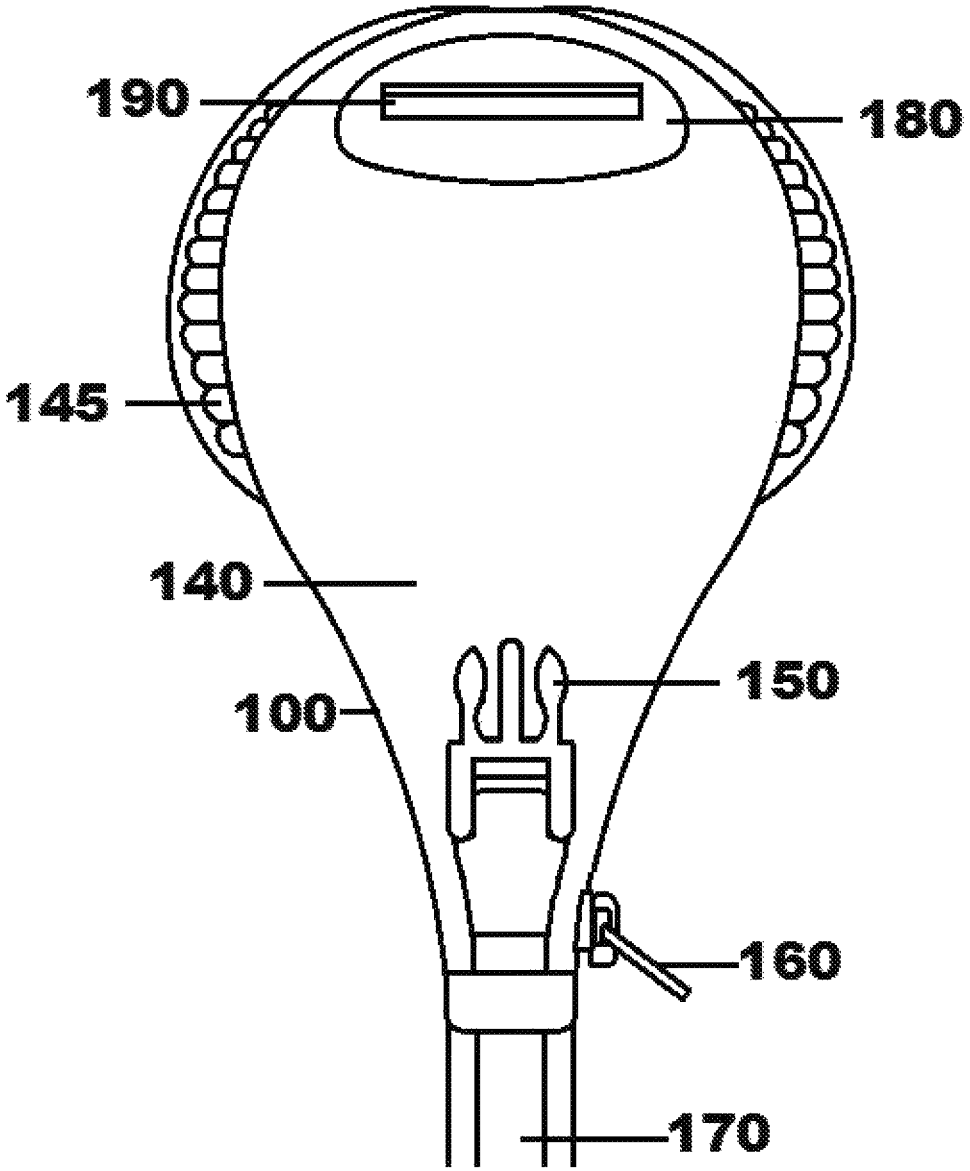
FIG. 8 illustrates an inside view of a shaver sponge accessory for a back shaver in the open position underneath the blade cartridges with an exposed blade mount and the blade cartridges cutaway and also the back shaver handle according to the first embodiment of the present inventions.

FIG. 8 illustrates an inside view of a shaver sponge accessory for a back shaver in the open position underneath the holder for the blade cartridges with an exposed blade mount 190 and the blade cartridges cutaway. The fabric sleeve 100 has an opening 180 on a razor blade side, the opening 180 of a size sufficient to pass a razor blade mount 190 therethrough. The fabric sleeve 100 is configured to surround most of the end of the shaver handle with the bottom side 140 showing. Also illustrated near the bottom in FIG. 8 is a cutaway of the back shaver handle 170 according to the first embodiment of the present inventions. Buckle 150 is illustrated unattached when in the illustrated open position. The zipper pull 160 is illustrated on a side of the fabric sleeve 100. Any other like reference numbers in FIG. 8 are described with respect to the textual description of FIG. 1.

Figure 9:
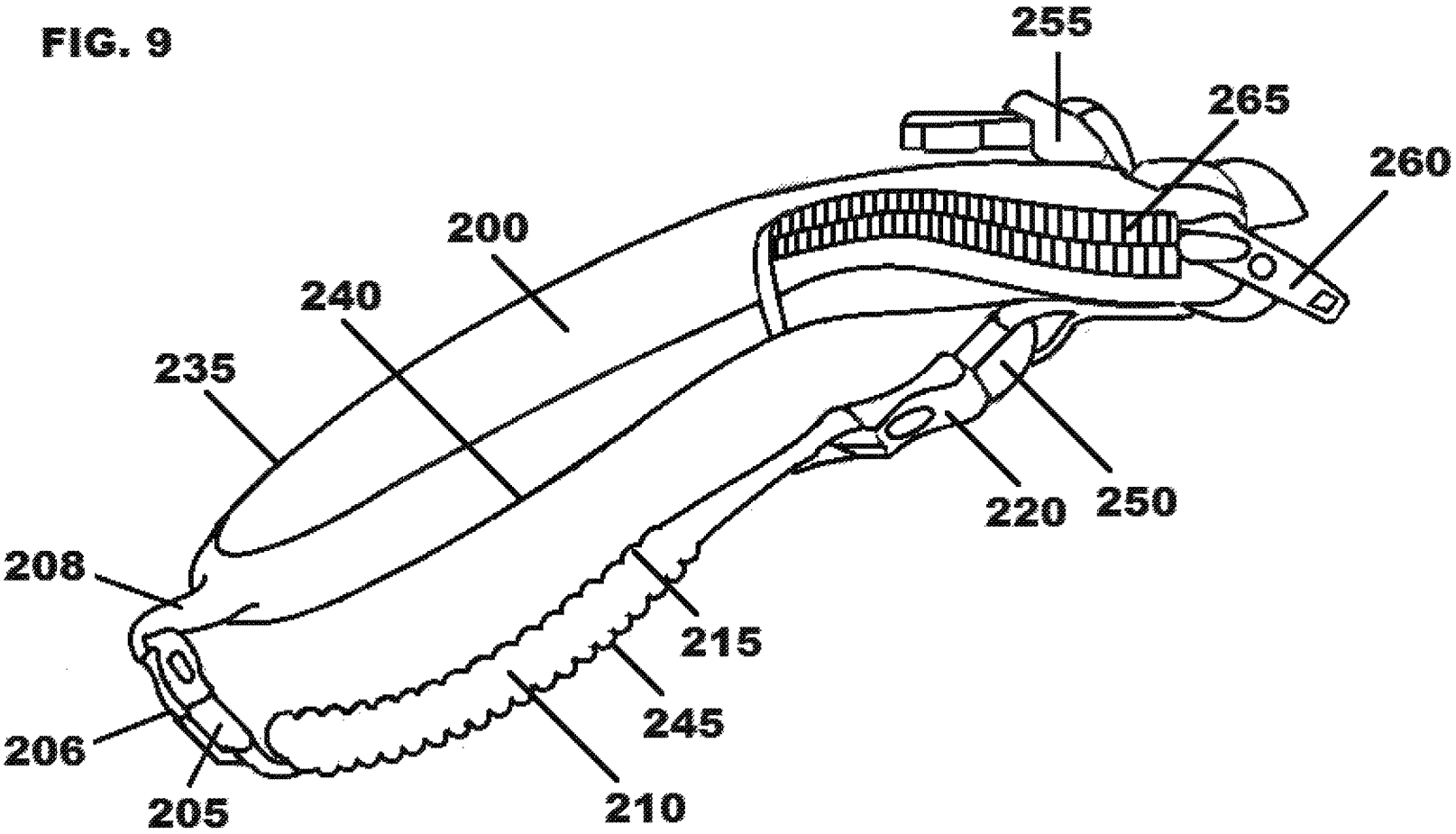
FIG. 9 illustrates a side view of a shaver sponge accessory with a sleeve for a back shaver in a closed position according to a second embodiment of the present inventions.

FIG. 9 illustrates a side view of a shaver sponge accessory with a sleeve for a back shaver in a closed position according to a second embodiment of the present inventions. A flap has sponge 210. The flap also has a hinge 208 at one end of the sponge 210. The hinge 208 is variably coupled to the sponge 210 by buckles 205 and 206. Buckle 205 is attached to the sponge 210 and buckle 206 is attached to the hinge 208 as illustrated in the second embodiment of FIG. 9. The flap also has a first securing mechanism 220 coupled to another end of the sponge 210 opposite the hinge 208.

The sponge 210 is a substantially planar sponge with the hinge 208 at one end of the substantially planar sponge and the first securing mechanism 220 at the another end of the substantially planar sponge. The hinge 208 is a hinge of a kind having at least a 270 degree range of motion. The fabric sleeve 200 is sized to fit over an end of a shaver handle opposite its grip. The hinge 208 is coupled to an outer end of the fabric sleeve 200. A top side 235 of the fabric sleeve 200 and a bottom side 240 of fabric sleeve 200 is illustrated in FIG. 9. The fabric sleeve 200 is configured to surround most of the end of the shaver handle.

The fabric sleeve 200 has a zipper 265 on a side thereof for closing the fabric sleeve 200 secured around the end of the shaver handle. A zipper pull 260 runs a traveler up and down the side of the sleeve 200 to open and close the zipper 265.

The fabric sleeve 200 has a second securing mechanism 255 configured to selectively attach to the first securing mechanism 220 when the flap is closed at the hinge 208 over a sharp edge of a razor blade with a primary surface 245 of the sponge 210 facing outwardly as illustrated in FIG. 3. The sponge 210 also has a secondary surface 215.

The first securing mechanism 220 and the second securing mechanism 255 each have complementary sides of a buckle pair 220, 255.

The fabric sleeve 200 has a third securing mechanism 250 configured to join to the first securing mechanism 220 when the hinge 208 is rotated at least 270 degrees in an opposite, open direction away from the razor blade 230 with the primary surface 245 of the sponge 210 facing inwardly as illustrated in FIG. 9.

The fabric sleeve 200 has a second securing mechanism 255 configured to selectively attach to the first securing mechanism 220 when the flap is closed at the hinge 208 over a sharp edge of a razor blade with a primary surface 245 of the sponge 210 facing outwardly.

The first securing mechanism 220 and the second securing mechanism 255 each have complementary sides of an outside buckle pair 220, 255. The first securing mechanism 220 and the third securing mechanism 250 each have complementary sides of an inside buckle pair 220, 250.

The fabric sleeve 200 can be made from a stretchy fabric such as a neoprene fabric.

Figure 10:
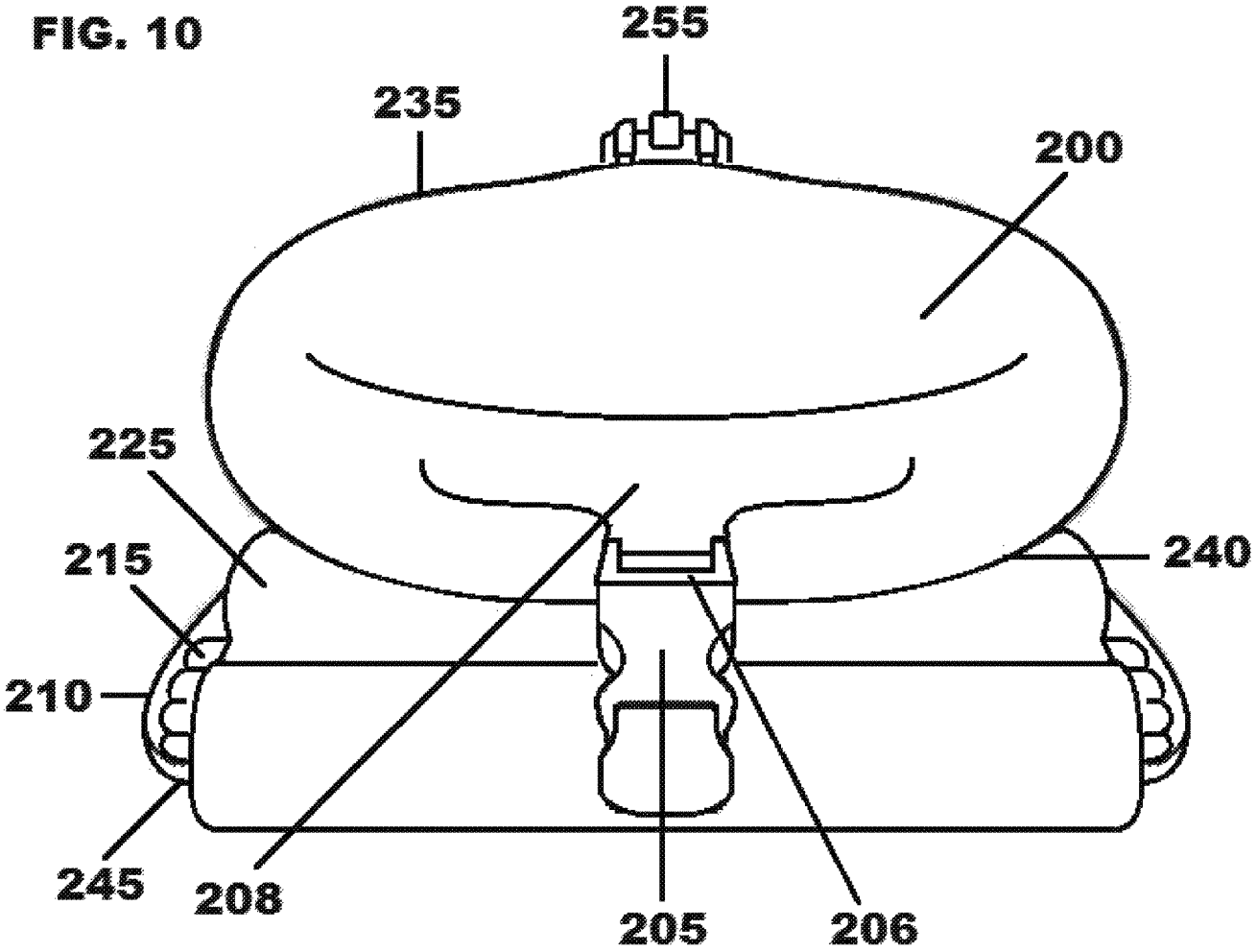
FIG. 10 illustrates an end view of a shaver sponge accessory with the sleeve for a back shaver in a closed position according to the second embodiment of the present inventions.

FIG. 10 illustrates an end view of a shaver sponge accessory with the sleeve for a back shaver in a closed position according to the second embodiment of the present inventions. The flap has a hinge 208 at one end of the sponge 210 hinged to a fabric sleeve 200. The fabric sleeve 200 has a bottom side 240 and a top side 235 that surrounds most of the end of the end of the back shaver handle opposite the grip. The hinge 208 is variably coupled to the sponge 210 by buckles 205 and 206. Hinge buckle 205 is attached to the sponge 210 and hinge buckle 206 is attached to the hinge 208. A primary surface 245 of the sponge 210 faces inwardly as illustrated. A secondary surface 215 of the sponge 210 faces outwardly as illustrated. The fabric sleeve 200 has a second securing mechanism 255. Any other like reference numbers in FIG. 10 are described with respect to the textual description of FIG. 9.

Figure 11:
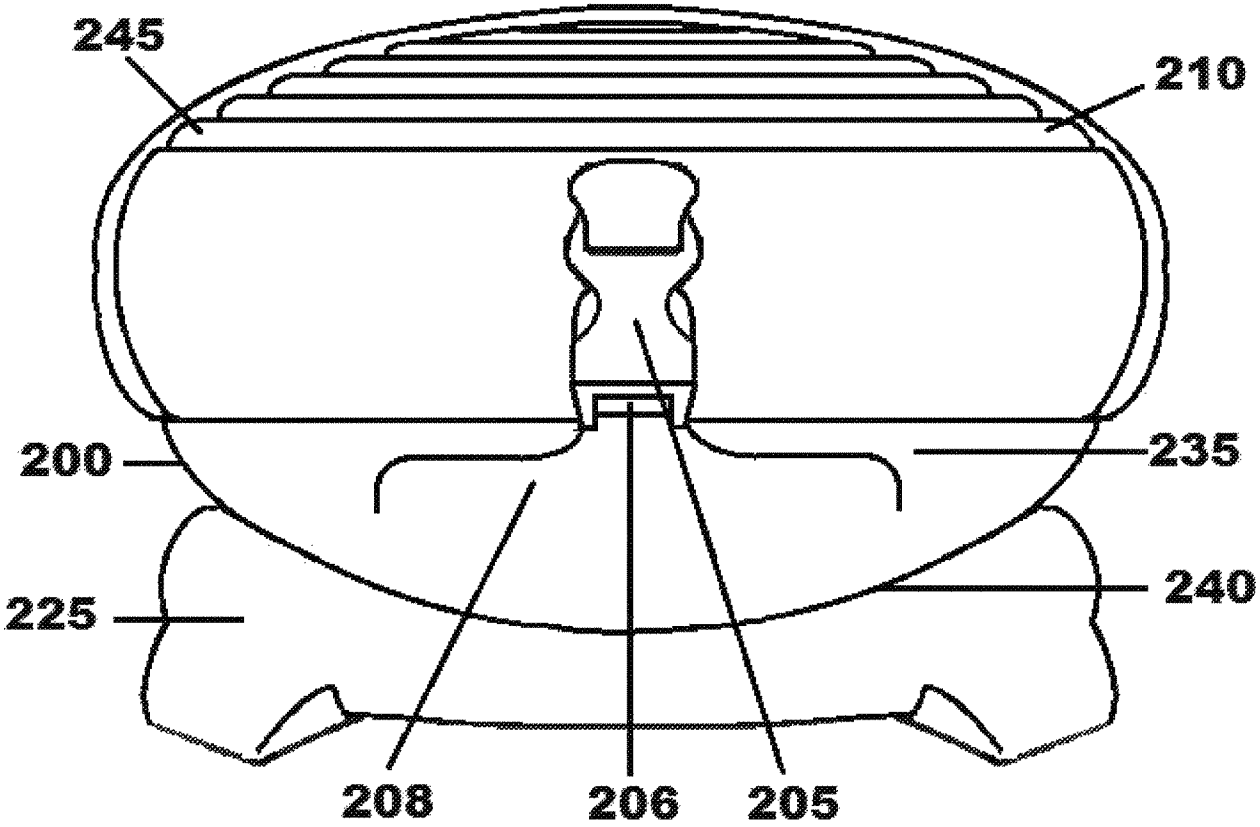
FIG. 11 illustrates an end view of a shaver sponge accessory with the sleeve for a back shaver in an open position according to the second embodiment of the present inventions.

FIG. 11 illustrates an end view of a shaver sponge accessory with the sleeve for a back shaver in an open position according to the second embodiment of the present inventions. A back side of a holder 225 for the razor blade cartridges is illustrated. The flap has a hinge 208 at one end of the sponge 210 hinged to a fabric sleeve 200. The fabric sleeve 200 has a bottom side 240 and a top side 235 that surrounds most of the end of the end of the back shaver handle opposite the grip. The hinge 208 is variably coupled to the sponge 210 by buckles 205 and 206. Hinge buckle 205 is attached to the sponge 210 and hinge buckle 206 is attached to the hinge 208. The flap also has a first securing mechanism 220 coupled to another end of the sponge 210 opposite the hinge 208. A primary surface 245 of the sponge 210 faces outwardly as illustrated.

Figure 12:
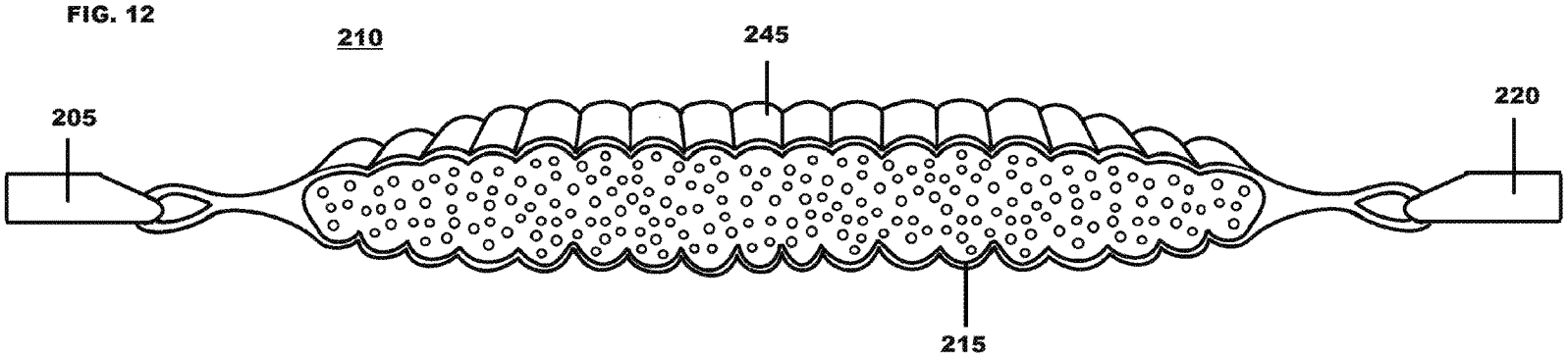
FIG. 12 illustrates a cutaway side view of a sponge according to embodiments of the present inventions.

FIG. 12 illustrates a cutaway side view of a sponge 210 according to embodiments of the present inventions. The sponge 210 of FIG. 12 can be used in the first, second or fourth embodiments. The sponge 210 has a primary surface 245 and a secondary surface 215. FIG. 12 also illustrates a first securing mechanism 220 and hinge or securing mechanism 205.

Figure 13:
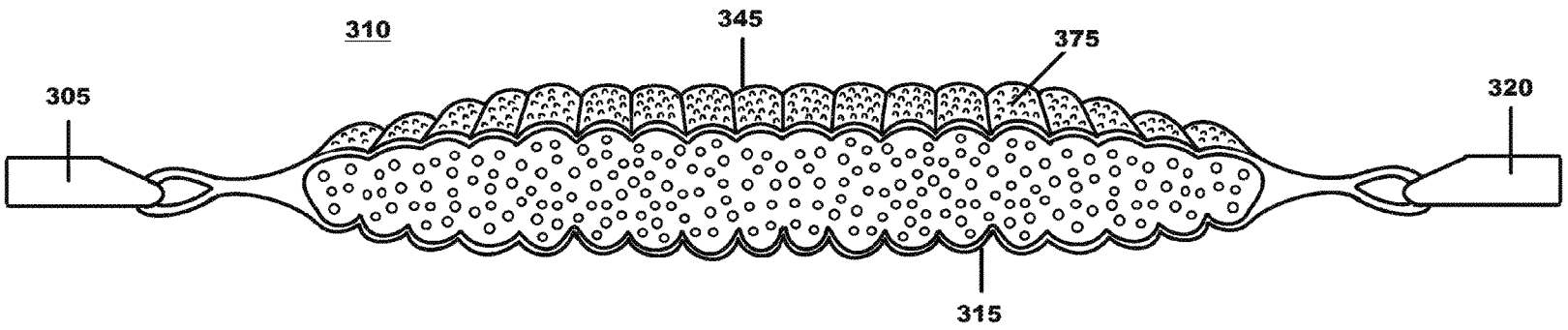
FIG. 13 illustrates a cutaway side view of a sponge with an exfoliating surface according to a third embodiment of the present inventions.

FIG. 13 illustrates a cutaway side view of a sponge with an exfoliating surface according to a third embodiment of the present inventions. The sponge 310 with exfoliating surface 375 of FIG. 13 can be used in the first, second or fourth embodiments. The sponge 310 has a primary surface 345 and a secondary surface 315. The sponge 310 has an exfoliating surface 375 on at least the primary surface 245 of the sponge 310. The exfoliating surface 375 is a material having characteristics to exfoliate human skin when rubbed against a back side of a user when the user reaches around the torso using the back shaver handle. FIG. 13 also illustrates a first securing mechanism 320 and hinge or securing mechanism 305.

Figure 14:
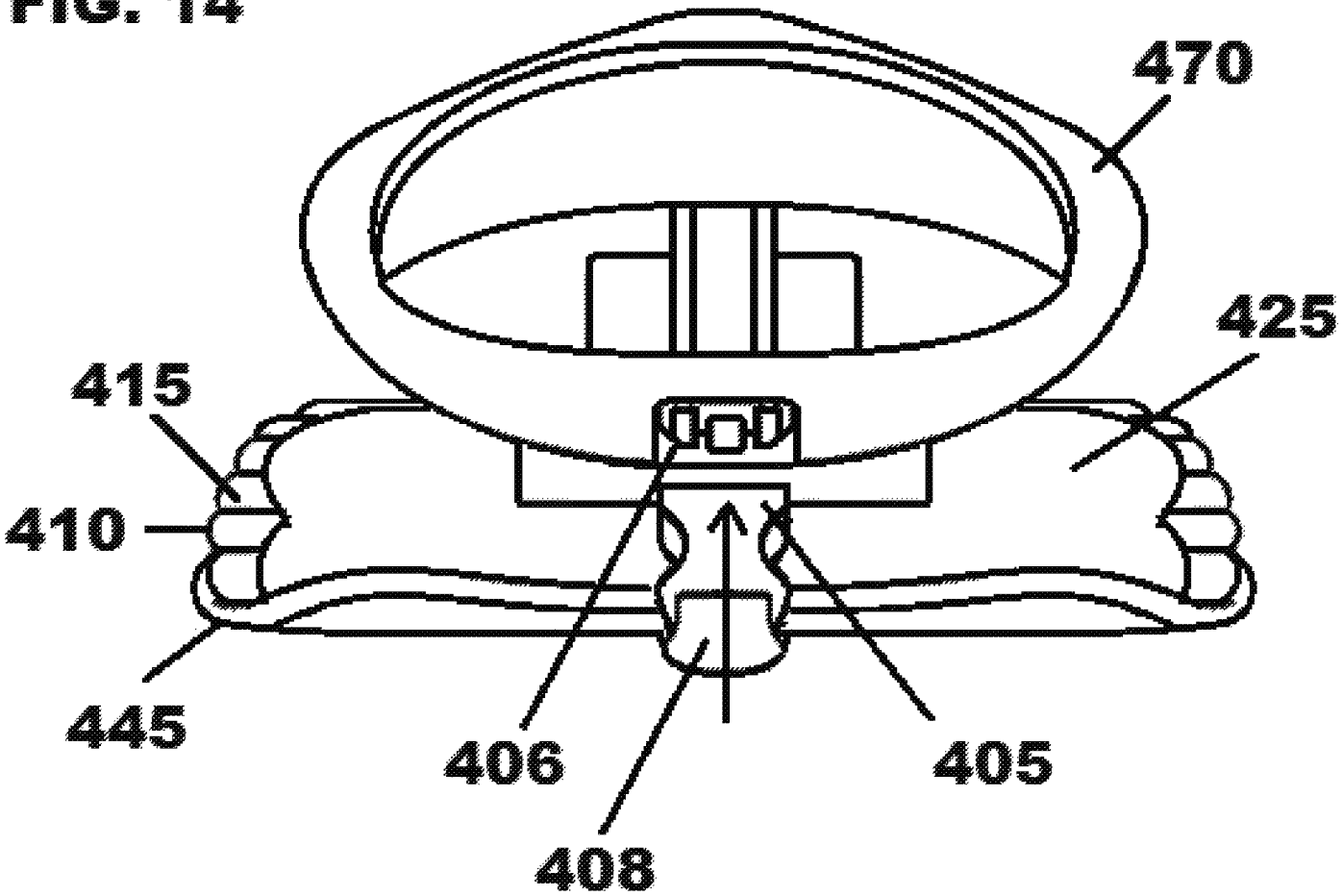
FIG. 14 illustrates an end view of a shaver sponge accessory for a back shaver in a closed position according to a fourth embodiment of the present inventions.

FIG. 14 illustrates an end view of a shaver sponge accessory for a back shaver in a closed position according to a fourth embodiment of the present inventions. Hinge securing mechanism 405 is attached to the hinge 408 opposite the sponge 410 in the fourth embodiment of FIG. 14. This hinge securing mechanism 405 in one preferred construction for the fourth embodiment is the illustrated male portion of a buckle pair configured to attach directly to the shaver at an end of a shaver handle 470 opposite a grip of the back shaver handle 470. A hinge securing mechanism 406 is integral to the back shaver handle 470 for mating with the hinge securing mechanism 405. The primary surface 445 of the sponge 410 faces outwardly as illustrated in the open position of FIG. 14. The sponge 410 also has a secondary surface 415 facing inwardly as illustrated in the closed position of FIG. 14.

Figure 15:
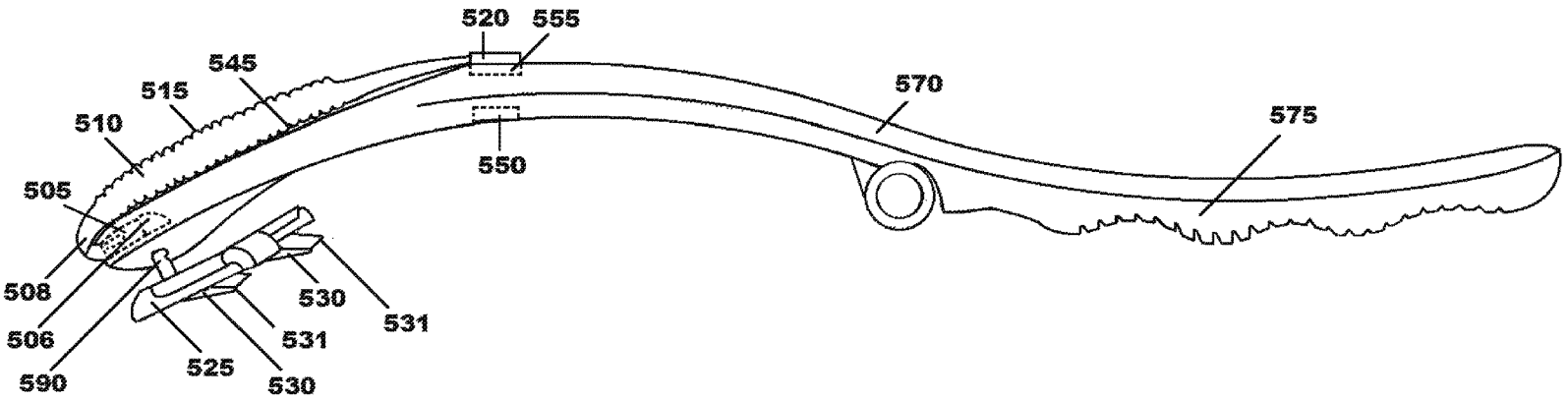
FIG. 15 illustrates a side view of a shaver sponge accessory for a back shaver in an open position according to the fourth embodiment of the present inventions.

FIG. 15 illustrates a side view of a shaver sponge accessory for a back shaver in an open position according to the fourth embodiment of the present inventions. A flap has sponge 510. The flap also has a hinge 508 at one end of the sponge 510. The flap also has a first securing mechanism 520 coupled to another end of the sponge 510 opposite the hinge 508. The sponge 510 is a substantially planar sponge with the hinge 508 at one end of the substantially planar sponge and the first securing mechanism 520 at the another end of the substantially planar sponge. The hinge 508 is a hinge of a kind having at least a 270 degree range of motion.

In a preferred construction the embodiment of FIG. 15, the first securing mechanism 520 is preferably a magnet. Magnetic material 550, 555 such as iron is embedded inside a shaver handle 570 opposite a grip 575 in a preferred construction the embodiment of FIG. 15. While one preferred construction is the first securing mechanism 520 being a magnet and the joining second and third securing mechanisms 550 and 555 being magnetic material embedded in the shaver handle 570, alternatively all three can be magnets. In a further alternative construction the first securing mechanism 520 can be magnetic material and the second and third securing mechanisms 550 and 555 can be magnets.

The first securing mechanism 520 and the second securing mechanism 555 each have complementary sides of an outside buckle pair 520, 555. The first securing mechanism 520 and the third securing mechanism 550 each have complementary sides of an inside buckle pair 520, 550. The first securing mechanism 520 is further configured to variably attach the another end of the substantially planar flap to the shaver when rotated about the hinge 508 in an open position as illustrated in FIG. 15.

The third securing mechanism 550 is configured to join to the first securing mechanism 520 when the hinge 508 is rotated at least 270 degrees in a opposite, open direction away from the razor blade 530 with the primary surface 545 of the sponge 510 facing inwardly as illustrated in the open position of FIG. 15. The sponge 510 also has a secondary surface 515 facing outwardly as illustrated in the open position of FIG. 15.

A hinge securing mechanism 505 is attached to the hinge 508 opposite the sponge 510 in the fourth embodiment of FIG. 15. This hinge securing mechanism 505 in one preferred construction for the fifth embodiment is the illustrated male portion of a buckle pair configured to attach directly to the shaver at an end of a shaver handle 570 opposite a grip 575 of the shaver handle 570. The hinge securing mechanism 505 is configured to attach directly into a cavity 506 in the end of the shaver handle 570. The cavity 506 forms a female portion of the buckle pair and can integrally contain an internal mating buckle securing portion for a buckle pair.

A holder 525 for blade cartridges 530 is illustrated, each blade cartridge 530 having a sharp edge 531. The hinge 508 at one end of the sponge 510 allows the flap to selectively cover the blade cartridges 530 in a closed position or be rotated and secured in an open position. The holder 525 is attached by mount 590 to the end of the back shaver handle 570.

Although the invention is described herein with reference to specific embodiments, various modifications and changes can be made without departing from the scope of the present inventions as set forth in the claims below. Accordingly, the specification and figures are to be regarded in an illustrative rather than a restrictive sense, and all such modifications are intended to be included within the scope of the present inventions. They can have different configurations than the examples illustrated in the drawings. Any benefits, advantages, or solutions to problems that are described herein with regard to specific embodiments are not intended to be construed as a critical, required, or essential feature or element of any or all the claims.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A shaver accessory for a razor having a shaver handle with a grip, the shaver accessory comprising:
- a flap, the flap comprising:
  - a sponge;
  - a hinge at one end of the sponge; and
  - a securing mechanism coupled to another end of the sponge opposite the hinge; and
- a fabric sleeve sized to fit over an end of the shaver handle of the razor opposite the grip of the shaver handle; and
- wherein the hinge is coupled to an outer end of the fabric sleeve; and
- wherein the hinge is configured to fold the sponge along a length of the fabric sleeve when the hinge is fully rotated.

2. A shaver accessory according to claim 1, wherein the sponge is a substantially planar sponge with the hinge at said one end of the substantially planar sponge and the securing mechanism at the another end of the substantially planar sponge.

3. A shaver accessory according to claim 1, wherein the hinge is a of a kind having at least a 270 degree range of motion.

4. A shaver accessory according to claim 1, wherein the fabric sleeve is configured to surround most of the end of the shaver handle of the razor.

5. A shaver accessory according to claim 4, wherein the fabric sleeve has an opening on a razor blade side of the razor, the opening of a size sufficient to pass therethrough a razor blade mount of the razor.

6. A shaver accessory according to claim 1, wherein the fabric sleeve comprises a zipper on a side thereof for closing the fabric sleeve secured around the end of the shaver handle of the razor.

7. A shaver accessory according to claim 1,
- wherein the securing mechanism is defined as a first securing mechanism; and
- wherein the fabric sleeve comprises a second securing mechanism configured to selectively attach to the first securing mechanism when the flap is closed at the hinge over a sharp edge of a razor blade of the razor with a primary surface of the sponge facing outwardly.

8. A shaver accessory according to claim 7, wherein the first securing mechanism and the second securing mechanism each comprise complementary sides of a buckle pair.

9. A shaver accessory according to claim 7, wherein the fabric sleeve comprises a third securing mechanism configured to join to the first securing mechanism when the hinge is rotated at least 270 degrees in an opposite, open direction away from the razor blade of the razor with the primary surface of the sponge facing inwardly.

10. A shaver accessory according to claim 9,
- wherein the first securing mechanism and the second securing mechanism each comprise complementary sides of an outside buckle pair; and
- wherein the first securing mechanism and the third securing mechanism each comprise complementary sides of an inside buckle pair.

11. A shaver accessory according to claim 4, wherein the hinge comprises threads stitched to join the fabric sleeve and the flap.

12. A shaver accessory according to claim 1, wherein the fabric sleeve is a neoprene fabric sleeve.

13. A shaver accessory according to claim 1, wherein the sponge has an exfoliating surface on at least one side of the sponge.

14. A shaver accessory according to claim 1, wherein the hinge is configured to attach to the fabric sleeve with the sponge facing at least outwardly when the flap is hinged over a sharp edge of a razor blade of the razor.

15. A shaver accessory according to claim 14, wherein the securing mechanism is configured to variably attach an end of the flap to the fabric sleeve opposite the hinge when rotated about the hinge in a closed position with the sponge facing at least outwardly when the flap is hinged over the sharp edge of the razor blade of the razor in the closed position.

16. A shaver accessory according to claim 15, wherein the securing mechanism is further configured to variably attach the end of the flap to the fabric sleeve opposite the hinge when rotated about the hinge in an open position.

17. A shaver accessory according to claim 16, wherein the hinge of the flap is capable of rotating at least 270 degrees between the closed position and the open position.

* * * * *